United States Patent [19]

Ghosh et al.

[11] Patent Number: 4,808,251

[45] Date of Patent: Feb. 28, 1989

[54] WATER-IN-OIL EMULSION EXPLOSIVE COMPOSITIONS CONTAINING ORGANOPHILIC SMECTITE CLAY

[75] Inventors: Pushpito K. Ghosh, New Bombay; Dhirendra N. Bhattacharyya; Rama S. Iyer, both of Bombay; Sudhakar V. Chikale, New Bombay; Arun K. Chattopadhyay, Bihar; Sasanka S. Paul, Bihar; Vattipalli M. Rao, Bihar, all of India

[73] Assignee: Iel Limited, West Bengal, India

[21] Appl. No.: 138,600

[22] Filed: Dec. 28, 1987

[51] Int. Cl.[4] ..... C06G 45/00

[52] U.S. Cl. ..... 149/2; 149/46

[58] Field of Search ..... 149/109.6, 2, 46, 60

[56] References Cited

U.S. PATENT DOCUMENTS 4,338,146 7/1982 Granlund ..... 149/2

4,722,757 2/1988 Cooper et al. ..... 149/2

*Primary Examiner*—Stephen J. Lechert, Jr.

*Attorney, Agent, or Firm*—Ladas & Parry

[57] ABSTRACT

The present invention relates to improved emulsion explosive compositions and their manufacture. More particularly, the invention relates to the provision of improved emulsion explosive compositions having reduced tackiness which permits them to be handled without difficulty and increased rigidity which enables them to maintain desired column height. The improved compositions also evince enhanced detonation sensitivity, improved shelf life over long periods of storage and greater resistance to shock or shear desensitisation though the precise reasons for these improvements are not always clear.

8 Claims, 1 Drawing Sheet

WATER-IN-OIL EMULSION EXPLOSIVE COMPOSITIONS CONTAINING ORGANOPHILIC SMECTITE CLAY

Since their introduction, emulsion explosives have become extremely popular as substitutes for earlier nitroglycerine-based explosives. Essentially, an emulsion explosive comprises a fuel phase made up of such components as paraffin wax, paraffin oil, slack wax and the like into which there is dispersed a supesaturated aqueous solution of inorganic nitrate salts referred to in the art as oxidiser salts. Other known ingredients such as thickening agents, cross-linking agents and emulsifiers are also generally included. It is also conventional practice to incorporate within the explosive matrix minute gas bubbles or physical voids such as glass microballoons each with a radius of from 50 to 100 micrometers. These bubbles or voids act as sensitisers for the explosive and constitute "hot spots" within the matrix.

Although emulsion explosives such as water-in-oil emulsion explosives are superior to earlier nitroglycerine explosives and therefore more popular, they do suffer from certain inherent drawbacks which tend to restrict the scope of their employment in a wider explosive field. The basic drawback from which most of the others stem lies in the tacky consistency and poor rigidity of water-in-oil emulsion explosive compositions. The direct consequence of the tackiness is that the compositions are extremely messy to handle and their poor rigidity is reflected in an inability of the compositions to retain proper column height resulting in a slumping within boreholes of cartridges prepared therefrom. Another shortcoming attributed to the tackiness and poor rigidity of water-in-oil emulsion explosives is the tendency of gas bubbles incorporated therein either to coalesce into bubbles of larger radius or to escape altogether. In either instance the composition loses its sensitivity and this loss is compounded as a result of the inherent instability of the emulsion matrix.

A number of efforts have been made in order to overcome the inadequacies of water-in-oil emulsion explosives. These include the incorporation thereinto of waxes such as microcrystalline wax which modify the rheological character of the compositions, the careful selection and blending within the compositions of emulsifiers, the addition of organic or polymeric additives such as those disclosed in South African Pat. No. 830251 and the incorporation with the explosive compositions of solid ingredients such as fillers or dopants.

The incorporation of substances such as those described does to some extent reduce tackiness and improve rigidity of the compositions in which they are incorporated. Unfortunately, their incorporation brings with it anothr undesirable effect. It has been found that after explosive compositions in which waxes, additives, fillers and or dopants are incorporated have been emulsified, the presence of the introduced solids, particularly inert solids, not only affects adversely the total energy of the explosives but lowers reactivity and reduces stability both during handling and subsequent storage.

It is thus a primary object of the present invention to provide an emulsion explosive composition which not only does away with the inherent drawbacks of such compositions but which also avoids the undesirable effects evinced by explosive compositions into which additives for reducing tackiness and increasing rigidity have been incorporated.

A more specific object of the invention is the provision of an improved water-in-oil emulsion explosive composition exibiting reduced tackiness and increased rigidity without loss of reactivity, sensitivity and stability during handling and storage.

Yet another object of the invention lies in a method for providing such an improved emulsion explosive composition.

As a result of their efforts, the applicants have found that the objects of this invention can be achieved by the incorporation within the emulsion matrix of a water-in-soil explosive composition of relatively small amounts of certain inorganic substances. This has the effect both of reducing the overall tackiness of the matrix and increasing its rigidity without loss of the other properties of the explosive such as reactivity, sensitivity and stability.

Examples of the inorganic substances which bring about the above-mentioned effects include organophillic smectite clays, inorganic silicates and silicas and/or combinations thereof. "Smectite" as employed herein is a general term for expandible clays having a layer lattice structure.

Accordingly, the present invention provides an improved water-in-oil emulsion explosive composition which comprises one or more inorganic oxidiser salts such as herein described, one or more carbonaceous fuels, one or more conventional emulsifiers and from 0.1% to 5% by weight based on the weight of the composition of an inorganic additive selected from the group consisting of organophillic smectite clays, inorganic silicates and silicas and combinations thereof.

The organophillic smectite clays employable as the inorganic additive are best exemplified by the commercially available bentones and smectones and these commercial forms have been found suitable for the present invention. Bentones and smectones may be conveniently prepared by ion-exchanging a smectite clay, e.g. bentonite, with quaternary ammonium salts possessing at least one or two long chain alkyl groups having at least ten carbon atoms. These organophillic clays are routinely employed as oil-soluble thickeners for the manufacture of lubricants, adhesives and paints but as far as the applicants are aware have never been employed in emulsion explosive formulations.

Examples of inorganic silicates include the various alumino-silicates while examples of silicas are the synthetically produced fumed or precipitated colloidal silicas, preferably those which have been surface-modified by treatment with organic silane derivatives such as alkyl chlorosilanes. As stated, both the inorganic silicates and silicas can be employed alone or in combination with the organophillic smectite clays as additives for reducing tackiness and increasing rigidity of the emulsion explosive matrix.

The preferred and principal inorganic oxidiser salt employed in the compositions of the present invention is ammonium nitrate. However, the composition can contain three or more different inorganic oxidiser salts selected from ammonium nitrate, calcium nitrate, sodium nitrate and potassium nitrate. The oxidiser salts are incorporated as an aqueous phase or as a melt and preferably the emulsion explosive composition comprises from 40% to 70% by weight ammonium nitrate and up to 20% of the other nitrates referred to above.

The carbonaceous fuels present in the composition of the present invention include most hydrocarbons such as paraffinic, olefinic, naphthenic, aromatic and even chlorinated hydrocarbons. Specific examples of such fuels include paraffin oil, diesel oil, paraffin wax, microcrystalline wax, slack wax and low sulphur heavy stock (LSHS) crude. Essentially, the fuel components constitute a fuel phase which is a water immiscible emulsifiable fluid that is either liquid at ambient temperatures or liquifiable up to a temperature of 85° C. but preferably below 65° C.

The emulsifiers incorporated in the composition of the present invention ae generally oil soluble emulsifiers of low hydrophillic lipophillic balance (HLB) value, e.g. less than 10. Examples of such emulsifiers include sorbitan monolaurate, sorbitan monooleate, sorbitan sesquioleate, sorbitan trioleate, sorbitan stearates and the like. These sorbitan-based emulsifiers are preferably derived by the esterification of sorbitol with long chain fatty acids.

Other useful emulsifiers include mono- and diglycerides of fat-forming fatty acids such as lecithin, polymeric surfactants based on the condensation of hydroxy stearic acid and polyethylene glycol of various molecular weights and the alkanolamine condensation products of polyisobutene or polybutadiene with maleic anhydride adducts.

In general, the emulsifiers which may be employed alone or in appropriate combinations are present in the composition of the present invention in an amount of from 0.5% to 5% by weight of the composition.

In accordance with a preferred feature, the fuel phase by itself or the mixture the fuel phase and emulsifier(s) comprises from 3% to 10% by weight of the explosive composition of the present invention.

The improved water-in-oil emulsion explosive composition of the present invention contains from 5% to 25% by weight of water.

Other ingredients conventionally found in emulsion explosive compositions can also be incorporated in the improved composition of the present invention. These ingredients include conventional thickening agents, conventional cross-linking agents and conventional gasifying agents such as sodium nitrite.

The invention also provides a method for the manufacture of an improved water-in-oil emulsion explosive composition which comprises dispersing into a continuous carbonaceous fuel phase from 0.1% to 5% by weight based on the weight of the composition of an inorganic additive selected from the group consisting of organophillic smectite clays, inorganic silicates and silicas and/or combinations thereof, adding to the dispersion so formed a solution or a melt of one or more inorganic oxidiser salts such as herein described in the presence of one or more conventional emulsifiers and thereafter subjecting the combined mixture to emulsification.

It has been found that by a proper selection of the inorganic additive or by altering the sequence and mode of the addition of the additive to the explosive matrix, it is possible to control the properties of the resulting emulsion explosive. This presents an added advantage in that it is possible to control the extent of tackiness and/or rigidity in the resultant explosive composition so as to provide a composition having particularly suitable characteristics for a specific application.

When the inorganic additive employed is an organophillic smectite clay, it is preferred to employ a clay which has been pre-treated with methanol or other appropriate polar liquid. Alternatively, such treatment can be effected during the course of the method of the present invention.

According to a preferred feature of the invention, therefore, minor amounts of 95% methanol or other polar liquids are added to said dispersion of fuel phase and clay additive prior to addition thereto of said inorganic oxidiser salts. Where a pre-treated clay is employed, the preferred clay used is Bentone SD-3 manufactured by NL Industries.

The applicants have found that if clay additives are not pre-treated, the emulsion matrix tends to break down under the shearing conditions to which an emulsion explosive is normally subjected during manufacture and during subsequent pumping of the explosive. On the other hand, when the additive clay is treated along the lines of the manner described or when a pre-treated clay is employed as the additive, interaction between the organophillic clay and the fuel phase is facilitated and this leads to a marked enhancement in the viscosity of the resultant fuel-clay matrix. The modified fuel phase in turn yields emulsion explosives having the desired characteristics for specific applications.

At present it is not fully understood what exactly causes the properties of an emulsion explosive to improve following the incorporation of the inorganic additives described herein. However, it is believed that these improvements can be attributed partly to the improved rheological characteristics imparted to the explosive matrix which enable the better retention of gas bubbles therein and partly to subtle structural changes within such matrix which the addition of the additives brings about. Examples of such changes as have been revealed by electron microscopic examination include, inter alia, a finer dispersion of the oxidiser phase.

Representative emulsion explosive compositions according to the present invention and the properties thereof are set out in the Table presented hereafter and procedure for the preparation of such compositions is disclosed in the following non-limitative Examples.

EXAMPLE 1

In accordance with standard procedure, a water-in-oil emulsion exlosive was prepared by dispersing an aqueous solution of inorganic nitrates into a fuel phase comprising a blend of paraffin oil and paraffin wax. Conventional additives in the form of an emulsifier and a gassing agent were also incorporated. On emulsification, the final explosive composition was found to be tacky and the penetration reading of the emulsion was 28 mm, the penetration reading increasing as rigidity of the composition decreases. After a storage period of 8 weeks, the explosive fired satisfactorily using a No. 8 aluminium electric detonator.

EXAMPLE 2

Procedure identical to that described in Example 1 was carried out with the exception that 0.5% by weight of pre-dried colloidal silica was added to the fuel oil phase prior to emulsification. The resultant emulsion explosive composition was non-tacky, more rigid and displayed a penetration reading of 23.6 mm which compared very favorably to the reading of the standard emulsion explosive of Example 1. As in the case of the emulsion explosive prepared according to Example 1, the explosive prepared by this example after being stored for a period of 8 weeks fired satisfactorily employing a No. 8 aluminium electric detonator.

EXAMPLE 3

The standard procedure of Example 1 was followed in order to prepare a conventional emulsion explosive with the exception that slack wax was employed as fuel in place of the paraffin oil-paraffin wax blend. The resulting explosive was tacky and soft with a penetration reading of 29 mm and after 8 weeks of storage was exploded with 10 g of Primex.

EXAMPLE 4

Procedure to that of Example 3 was carried out with the exception that 0.75% by weight of a smectone clay (an organophilic clay obtained from Cutch Oil and Allied Industries Private Limited, India) was added to the fuel phase along with 0.05% by weight of methanol as a swelling agent prior to emulsification. The final emulsion explosive was non-tacky and considerably more rigid than the conventional explosive prepared by Example 3 with a penetration reading of 23. 2 mm which compares very favourably with the penetration reading of the known explosive. After 8 weeks of storage, the explosive prepared by this example fired satisfactorily even with a No. 8 aluminium electric detonator.

significantly improves the emulsion explosives from the point of view of reduced tackiness and greater imparted rigidity without detracting from the sensitivity of the explosives. What is more, a comparison of the sensitivity data obtained in respect of Composition 7 (control) and Composition 9 (0.5% smectone) both in the fresh as well as on storage indicates a distinct improvement in the firing properties of those emulsions contaning inorganic additives such as the organophilic smectone clays. In addition, studies of the velocity of detonation (VOD) along the length of cartridges prepared from such emulsions revealed that the smectone-containing emulsions underwent practically no change in their VOD profile upon shock/shear abuse whereas the control batch of Composition 7 failed to detonate following similar abuse. The VOD profiles of these two compositions are set out graphically in FIGS. 1 and 2 of the accompanying drawings.

TABLE 1

Figure 1:
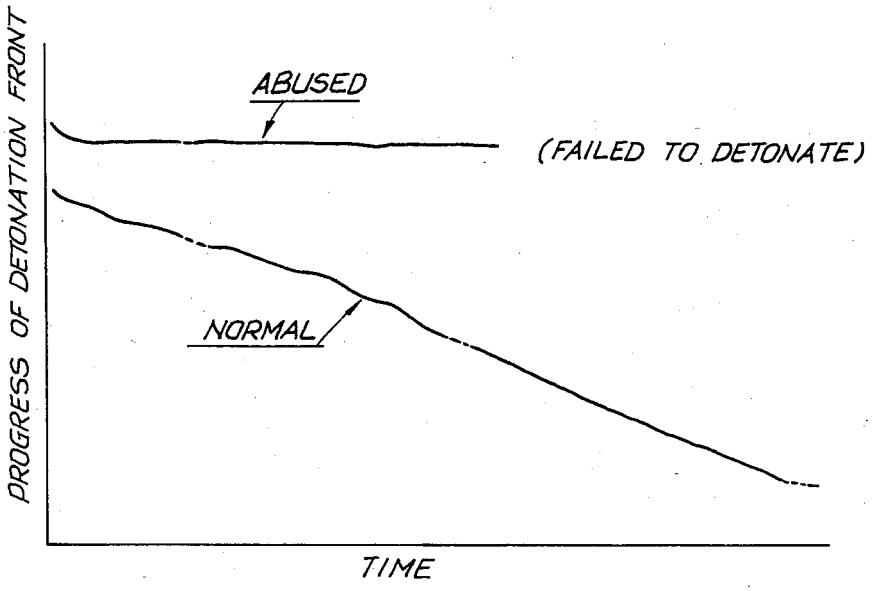
FIG. 1 is a graph that depicts VOD of composition 7 by plotting the "progress of detonation" vs. "time" for composition 7 subject to normal conditionsand shock-shear abuse.
Figure 2:
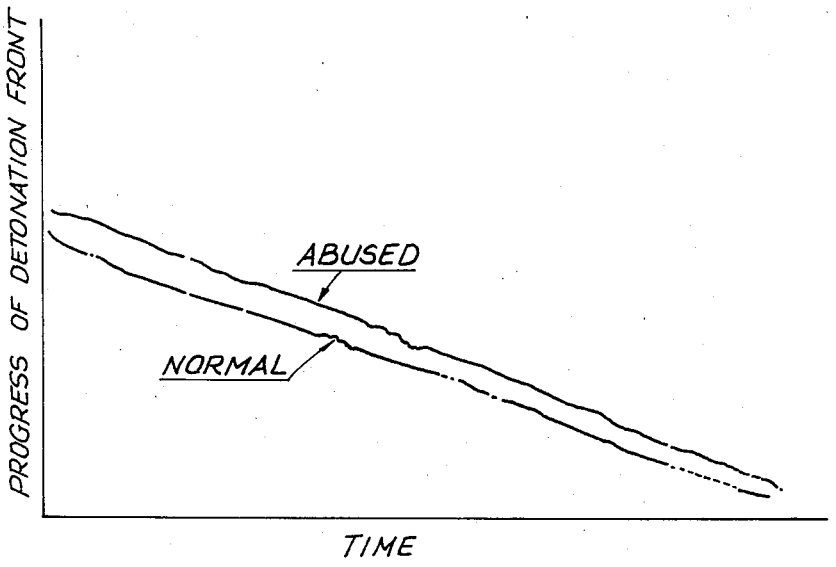
FIG. 2 is a graph that depicts VOD of the Smectone—containing emulsions by plotting the "progress of detonation" vs. "time" for the Smectone—containing emulsions subject to normal conditions and shock-shear abuse.

| | 1 | 2 | 3 | 4 | 5 | 6 | 7 | 8 | 9 |
|---|---|---|---|---|---|---|---|---|---|
| Ingredients | weight percent | | | | | | | | |
| Ammonium Nitrate | 65.85 | 65.35 | 65.30 | 65.30 | 65.85 | 65.30 | 71.00 | 71.00 | 71.00 |
| Sodium/Potassium/ Calcium Nitrate(s) | 11.20 | 11.20 | 11.00 | 11.00 | 11.20 | 11.00 | 9.34 | 9.09 | 8.84 |
| Water | 16.80 | 16.80 | 16.80 | 16.80 | 16.80 | 16.80 | 13.50 | 13.50 | 13.50 |
| Paraffin Oil: Paraffin Wax (1:1.25) | 4.50 | 4.50 | 4.50 | 4.50 | — | — | — | — | — |
| Slack Wax | — | — | — | — | 4.50 | 4.50 | — | — | — |
| Low Sulfur Heavy Stock (LSHS) | — | — | — | — | — | — | 4.50 | 4.50 | 4.50 |
| Thiourea | 0.10 | 0.10 | 0.10 | 0.10 | 0.10 | 0.10 | 0.10 | 0.10 | 0.10 |
| Emulsifier(s) | 1.50 | 1.50 | 1.50 | 1.50 | 1.50 | 1.50 | 1.50 | 1.50 | 1.50 |
| Sodium Nitrite (Gassing Agent) | 0.05 | 0.05 | 0.05 | 0.05 | 0.05 | 0.05 | 0.06 | 0.06 | 0.06 |
| Additives: | | | | | | | | | |
| (A) Smectone HR (a) | — | — | 0.50 | 0.75 | — | 0.75 | — | 0.25 | 0.50 |
| (B) Colloidal Silica | — | 0.50 | 0.25 | — | — | — | — | — | — |
| Properties: | | | | | | | | | |
| Density (g/ml) | 1.03 | 1.09 | 1.03 | 1.09 | 1.03 | 1.10 | 1.12 | 1.14 | 1.12 |
| Velocity of detonation (km/sec) | 3.6 | 3.6 | 3.6 | 3.6 | 3.6 | 3.6 | 3.6 | 3.6 | 3.6 |
| Initiation Sensitivity (b) in 32 mm diameter (unconfined) | | | | | | | | | |
| Fresh | AED-8 10gPx | AED-8 10gPx | AED-6 10gPx | AED-8 10gPx | AED-8 10gPx | AED-8 10gPx | AED-8 10gPx | CED-6 AED-6 | CED-6 AED-6 |
| 12 weeks' ambient storage | | | | | | | | | |
| 20 weeks' ambient storage | — | — | — | — | — | — | — | AED-8 | AED-8 |
| Cone penetration (mm), ASTM (c) | 28.4 | 23.6 | 24.3 | 25.5 | 29.0 | 23.2 | 22.0 | 21.2 | 19.2 |
| Tackiness (d) (By finger touch-qualitative | C | A | A | B | C | A | C | B | A |
| Capacitance (nF), (e) | | | | | | | | | |
| Normal | — | — | — | — | — | — | 35 | 12.6 | 17.1 |
| Abused (f) | — | — | — | — | — | — | 48 | 13.2 | 17.1 |

(a) From Cutch Oil and Allied Industries Pvt. Ltd., India.
(b) Data indicates minimum initiator required for detonation; emulsion sensitivity follows the trend CED-6 > AED-6 > AED-8 > 10gPx Where AED = Aluminium electric detonator, CED = Copper electric detonator and P = Pentolite booster
(c) Lower value of cone penetration indicates higher rigidity
(d) A,B and C denote relative degree of tackiness with 'A' as minimum and 'C' as maximum
(e) — indicates data not available
(f) emission cartridges were abused by dropping them five times from a height of six feet.

It is more than evident from the above-mentioned Table that the incorporation of the inorganic additives It will be obvious to those skilled in the art that many other modifications, substitutions, combinations and sub-combinations of ingredients and procedues are possible within the scope of the invention described herein.

We claim:

1. An improved water-in-oil emulsion explosive composition which comprises one or more inorganic oxidizer salts selected from ammonium nitrate, calcium nitrate, sodium nitrate, potassium nitrate and mixtures thereof, one or more carbonaceous fuels, one or more conventional emulsifiers and from 0.1% to 5% by weight based on the weight of the composition of an inorganic additive which is an organophillic smectite clay wherein said organophillic smectite clay is a clay which has been pre-treated with methanol or other appropriate polar liquid.

2. A composition as claimed in claim 1 wherein said organophillic smectite clay is selected from the group consisting of bentones and smectones.

3. A composition as claimed in claim 2 wherein said bentones and smectones have been prepared by ion-exchanging a smectite clay with quaternary ammonium salts possessing at least one or two long chain alkyl groups having at least ten carbon atoms.

4. A composition as claimed in claim 1 wherein ammonium nitrate is present in an amount of from 40% to 70% by weight and other nitrates are present in amounts of up to 20% by weight.

5. A composition as claimed in claim 1 wherein said emulsifiers are present in an amount of from 0.5% to 5% by weight based on the weight of the composition.

6. A composition as claimed in claim 1 wherein said fuel phase by itself or said fuel phase and said emulsifiers taken together are present in an amount of from 3% to 10% by weight based on the weight of the composition.

7. A composition as claimed in claim 1 wherein water is present in an amount of from 5% to 25% by weight.

8. A composition as claimed in claim 1 which includes one or more conventional thickening agents, one or more conventional cross-linking agents and one or more conventional gasifying agents or combinations of any of these.

* * * * *